US006095752A

United States Patent [19]

Gronier et al.

[11] Patent Number: 6,095,752

[45] Date of Patent: Aug. 1, 2000

[54] CENTRIFUGAL BLOWER IMPELLER, ESPECIALLY FOR A HEATING AND VENTILATING, AND/OR AIR CONDITIONING, SYSTEM FOR A MOTOR VEHICLE

[75] Inventors: Pascale Gronier, Montigny le Bretonneux; Bernard Boucheret, Gennevilliers; Jérôme Clauzel, Paris, all of France

[73] Assignee: Valeo Clamitisation, La Verriere, France

[21] Appl. No.: 08/996,969

[22] Filed: Dec. 23, 1997

[30] Foreign Application Priority Data

Dec. 26, 1996 [FR] France ..... 96 16055

[51] Int. Cl.[7] ..... B63H 1/16; F01D 5/22

[52] U.S. Cl. ..... 416/186 R; 416/195; 416/187

[58] Field of Search ..... 416/181, 185, 416/186 R, 187, 188, 178, 180, 182, 184, 189

[56] References Cited

U.S. PATENT DOCUMENTS

| | | | |
|---|---|---|---|
| 1,614,091 | 1/1927 | Van Toff | 416/186 R X |
| 2,330,938 | 10/1943 | Williams | 416/187 X |
| 2,650,755 | 9/1953 | Woodward | 416/186 R X |
| 2,803,398 | 8/1957 | Sprouse | 416/187 |
| 3,692,428 | 9/1972 | Bubb et al. | 416/187 |
| 3,846,043 | 11/1974 | Wolbrink et al. | 416/187 X |
| 4,365,931 | 12/1982 | Dellacha | 416/186 R X |
| 4,432,694 | 2/1984 | Kuroda et al. | 416/186 R X |
| 4,470,753 | 9/1984 | Witzel | 416/181 X |
| 4,647,271 | 3/1987 | Nagai et al. | 416/186 R |
| 4,762,465 | 8/1988 | Friedrichs | 416/185 |
| 4,838,762 | 6/1989 | Savage et al. | 416/187 |
| 5,810,557 | 9/1998 | Akinkuotu et al. | 416/186 R X |
| 6,023,939 | 2/2000 | Correa | 416/178 X |

FOREIGN PATENT DOCUMENTS

| | | |
|---|---|---|
| 354 156 | 2/1990 | European Pat. Off. . |
| 564 938 | 10/1993 | European Pat. Off. . |
| 2 236 384 | 1/1975 | France . |
| PS 1 65 432 | 12/1904 | Germany . |
| AS 1 083 481 | 6/1960 | Germany . |
| 4204531 | 8/1993 | Germany . |
| 195 04 970 A1 | 8/1996 | Germany . |
| 195 31 160 A1 | 2/1997 | Germany . |
| 2 060 069 | 4/1981 | United Kingdom . |

OTHER PUBLICATIONS

English (Derwent) Abstract of DE 195 04 970 A1.
English (Derwent) Abstract of DE 195 31 160 A1.
English translation of selected portions of DE–AS 1 083 481.
English translation of selected portions of DE–PS 1 65 432.

*Primary Examiner*—John E. Ryznic
*Attorney, Agent, or Firm*—Morgan & Finnegan, LLP

[57] ABSTRACT

A centrifugal blower impeller for a vehicle heating and ventilation system has a central hub, a peripheral crown having a set of vanes for drawing the air axially through the crown, to deliver the air radially towards the outside, and a set of arms, spaced apart at regular intervals and joining the hub to the crown. This set of arms defines a generally concave bowl-shaped envelope, with the arms being joined to the hub in the center of the bowl and with the crown at its periphery. At least some of the arms have reinforcing ribs close to the junction between the arm and the hub. Each rib lies in an axial plane and is on the side of the arm corresponding to the concavity of the bowl.

20 Claims, 2 Drawing Sheets

CENTRIFUGAL BLOWER IMPELLER, ESPECIALLY FOR A HEATING AND VENTILATING, AND/OR AIR CONDITIONING, SYSTEM FOR A MOTOR VEHICLE

FIELD OF THE INVENTION

This invention relates to centrifugal blower impellers, such as those which, in particular, incorporated in the blowers of systems for heating and ventilating, and or air conditioning, in motor vehicles.

BACKGROUND OF THE INVENTION

It is well known that such impellers have a central hub which is arranged to be mounted on a motor shaft, with a peripheral crown having a succession of vanes or blades for aspirating air axially through the interior of the crown and to deliver it radially towards the outside, together with a set of arms which join the hub to the peripheral crown. These impellers are generally made from one piece, in a molded synthetic material, which imposes a certain number of limitations as regards to mechanical strength and moldability during A design of the various parts of the impeller. It will easily be understood that the arms are subjected to high mechanical stresses, which have to be taken into account during design and choice of material.

DISCUSSION OF THE INVENTION

One of the objects of the invention is to enhance the mechanical strength of the whole impeller, particularly as regards to the arms, in such a way as to increase the mechanical rigidity of the arms, and/or to enable the choice of material to be widened to include plastics material having reduced mechanical properties.

According to the invention, a centrifugal blower impeller, especially for a heating and ventilating, and/or air conditioning, system for a motor vehicle, comprises: a central hub adapted to be mounted on a motor shaft; a peripheral crown portion having a set of vanes for drawing air axially through the interior of the crown portion and for delivering it radially towards the outside; and a plurality of arms joining the hub to the peripheral crown portion, with the set of arms defining a generally concave envelope in the form of a bowl, the arms being joined to the hub at the centre of the bowl, and to the crown portion at the periphery of the bowl, is wherein at least some of the arms carry, in the region adjacent to the junction of the arm with the hub, reinforcing ribs which extend in an axial plane within the concavity of the bowl.

According to a preferred feature of the invention, the reinforcing ribs are generally triangular, having a short first side joined to a generatrix of the hub, a longer second side joined to the arm itself, and a free third side which faces towards the inside of the concavity of the bowl.

Preferred dimensions of these reinforcing ribs are defined by a ratio between the length of the said second side and the total length of the arm in the range between 30% and 70%; and the ratio between the thickness of the rib and the thickness of the arm is preferably in the range between 15% and 40%.

According to another preferred feature of the invention, the arms have, in the region of the arm adjacent to its junction to the hub, a region of reduced thickness extending over part of the length of the rib.

Further features and advantages of the invention will appear more clearly on a reading of the following detailed description of a preferred embodiment of the invention, which is given by way of non-limiting example only and with reference to the accompanying drawings.

DESCRIPTION OF A PREFERRED EMBODIMENT OF THE INVENTION

Figure 1:
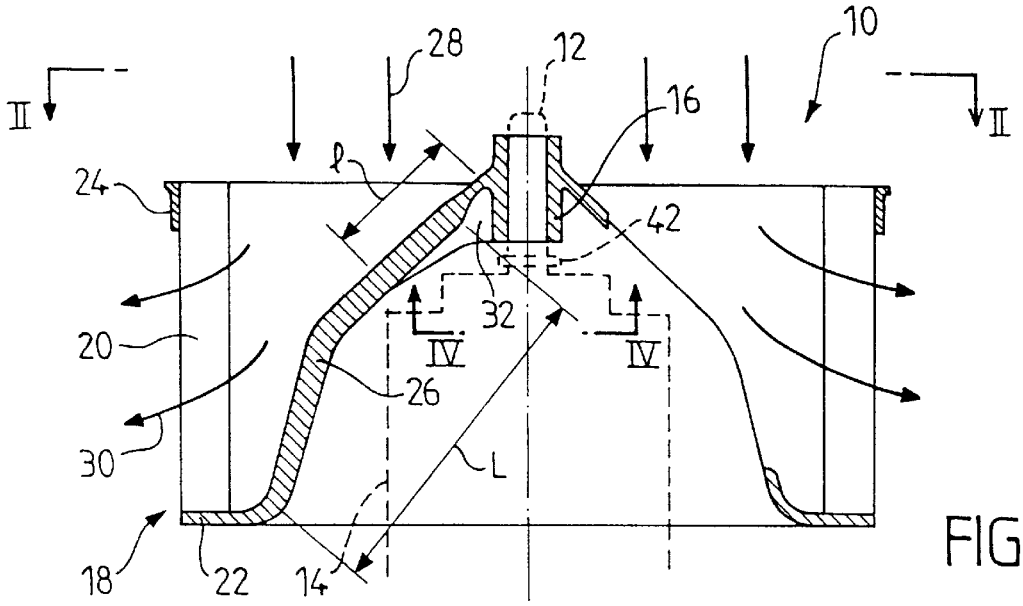
FIG. 1 is a view in cross-section, taken on the line I—I in FIG. 2, of a centrifugal blower impeller according to the present invention.
Figure 2:
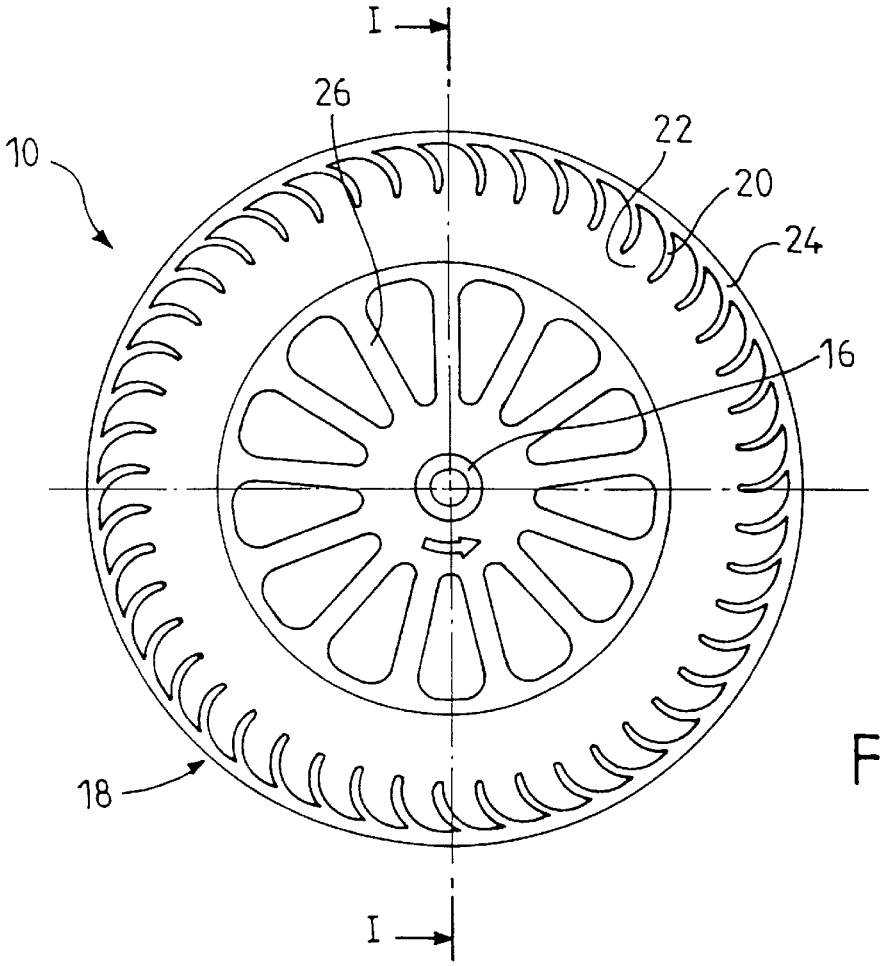
FIG. 2 is a view in plan, as seen in the direction indicated at II—II in FIG. 1, of the same centrifugal blower impeller.

FIGS. 1 and 2 show generally a centrifugal blower impeller 10, which is typically made in one piece by injection molding in a suitable synthetic resin. This impeller is designed to be fitted on the shaft 12 of a drive motor 14, by means of a hub 16 into which the shaft 12 is force fitted.

The impeller 10 has the general form of a flattened cylinder, the overall diameter of which is greater than its height. A typical example of such an impeller, which is of course not limiting, has an overall diameter of 140 mm for a height of the cylindrical portion of 70 mm.

The outer part of the blower impeller 10 comprises a circular peripheral crown portion 18, carrying a large number of vanes or blades 20. The individual vanes are joined together by a common element 22 in the form of a circular crown element or ring, this being on the lower side as shown in FIG. 1; while on the other side, the vanes are joined together by a cylindrical stiffening element 24. The peripheral crown portion 18 is joined, via the crown element 22, which is generally in the form of a circular disk, to the hubs 16 through a set of arms 26. In order to give the maximum possible compactness to the machine, the hub 16 is located axially on the opposite side from the disk-shaped element 22, so that part of the casing of the motor 14 can be accommodated within a central space of the impeller, as is shown in FIG. 1.

This particular configuration gives the set of arms 26 the general configuration of a bowl, the center of which coincides with the hub 16, with the perimeter of the bowl being joined, at 22, to the peripheral crown portion.

When the impeller is driven in rotation, air is impelled by the vanes 20 radially outwardly by centrifugal effect, which produces aspiration of air in the axial direction indicated by the arrows 28, from the side of the machine opposite to that in which the motor 14 is located, the aspirated air being then driven into the radial direction as indicated by the arrows 30. It can thus been seen, with reference to FIG. 1, that the flow of air which is aspirated on the suction side of the machine, downwardly with respect to this Figure, is then delivered laterally along a path which follows substantially the arms 26. This is why the form of these arms is of importance from the aerodynamic point of view. In addition, the arms exert a driving force on the layer of air adjacent to them, so that they play a part in the cooling of the motor 14 by causing a stream of air to flow into the internal space of the impeller, in which the motor is mounted.

Figure 3:
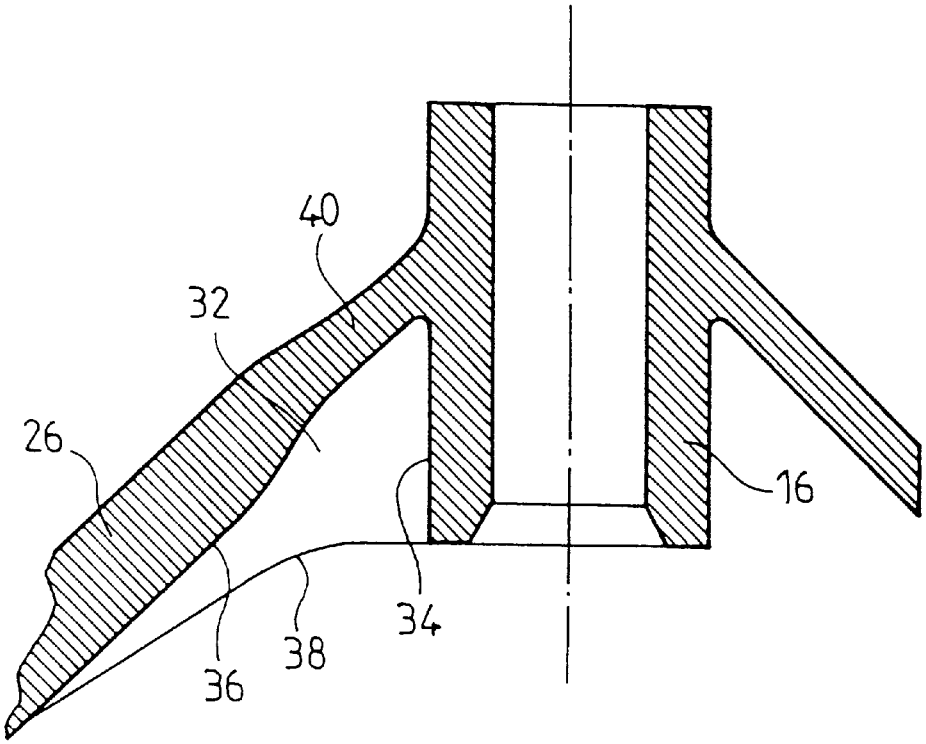
FIG. 3 repeats, on a larger scale, a part of FIG. 1 in the region of a reinforcing rib of an arm.
Figure 4:
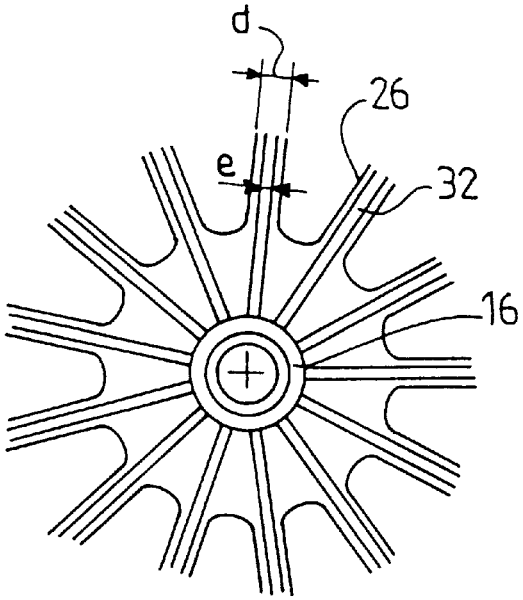
FIG. 4 is a scrap view, looking upwards in the direction of the arrows IV—IV in FIG. 1, of the centre of the blower impeller, showing in particular the various arms and their ribs.

At least some, and preferably each one, of the arms 26 have a reinforcing rib 32 in the junction region in which the rib joins the hub 16. These reinforcing ribs 32 are situated in the concave region of the bowl, that is to say they face towards the motor 14. The ribs 32 are shown on a larger scale in FIG. 3. Each rib 32 has a substantially triangular shape, with a short side 34 which is joined to a generatrix of the hub 1 6, a long side 36 which is joined to the arm 26 (extending along the latter as can be seen in the bottom plan view of FIG. 4), and a free third side 38 which faces into the concavity of the bowl.

In the dimensional example mentioned above, the ribs 26 may extend over a length/(FIG. 1) of about 30 mm for a total length L of the arm of about 75 mm. As to the short side 34 joined to the hub, this may have a length of the order of 10 mm. It will be noted that the free edge 38 is so configured as to give it a slight rounded portion which enables it to match the form of the casing of the motor 14, indicated in broken lines in FIG. 1. For a dimension d in the transverse direction of the arms (i.e. the thickness) of 5 mm, the rib 26 may for example have a thickness e of the order of 1.5 mm.

Such a configuration confers a very high degree of mechanical reinforcement on the impeller. If desired the portion 40 of the arm which is closest to the hub 16 may be of reduced thickness in order to facilitate the junction of the set of arms 26 to the hub 16. It will be noted that the location of the reinforcing ribs on the concave side of the bowl, which is contrary to conventional practice, has a considerable advantage from the noise point of view, as compared with ribs placed on the opposite side.

Moreover, by locating the ribs in this way, the air situated in the space between the motor 14 in the interior of the bowl defined by the arms 16 is subjected to high degree of turbulence, the result of which is that the upper region of the motor, and most particularly its top bearing 42 (FIG. 1), is very well ventilated.

What is claimed is:

1. An impeller for a centrifugal blower, comprising:

a hub adapted to mount onto a motor shaft of the centrifugal blower;

a crown portion having a set of vanes for drawing air axially through an interior of the crown portion and for delivering the drawn air radially towards the outside; and a plurality of arms connecting the hub and the crown portion, the plurality of arms defining a generally concave bowl-shaped envelope, the plurality of arms being connected to the hub in a center of the bowl, with the crown portion at a periphery of the bowl, wherein at least one of the plurality of arms includes a rib proximal to a junction of the at least one of the plurality of arms with the hub, the rib extending in an axial plane and being on a side of the at least one of the plurality of arms facing into the concavity of the bowl.

2. The impeller according to claim 1, wherein the rib has a substantially triangular shape defined by a first side, second side and third side, the first side connected to a generatrix of the hub, the second side, longer than the first side, connected to the at least one of the plurality of arms along a length of the second side, the third side facing an interior of the concavity of the bowl.

3. The impeller according to claim 2, wherein the second side has a length between 30% to 70% of a total length of the at least one of the plurality of arms.

4. The impeller according to claim 1, wherein the rib has a thickness between 15% and 40% of a thickness of the at least one of the plurality of arms.

5. The impeller according to claim 1, wherein the at least one of the plurality of arms has a region of reduced thickness adjacent to the hub, the region extending over part of a length of the rib.

6. The impeller according to claim 2, wherein the third side has a portion adapted to match a motor casing of the centrifugal blower.

7. The impeller according to claim 1, wherein the hub, the crown portion, the plurality of arms and the rib are molded as a single piece.

8. The impeller according to claim 1, wherein the hub, the crown portion, the plurality of arms and the rib are made from a synthetic resin.

9. A centrifugal blower comprising:

a motor having a motor shaft; and the impeller according to claim 1.

10. An air distribution system selected from the group consisting of a heating system for a motor vehicle, a ventilating system for a motor vehicle and an air conditioning system for a motor vehicle, including the centrifugal blower of claim 9.

11. A motor vehicle including the air distribution system according to claim 10.

12. An impeller for a centrifugal blower, comprising:

a hub adapted to mount onto a motor shaft of the centrifugal blower;

a crown portion including at least one air vane;

a plurality of arms connected between the hub and the crown portion, the plurality of arms defining a generally concave region; and a rib connected between one of the plurality of arms and the hub, the rib being situated in the concave region.

13. The impeller according to claim 12, wherein the rib is proximal to a junction of the hub and the one of the plurality of arms.

14. The impeller according to claim 12, wherein the rib has a substantially triangular shape defined by a first side, second side and third side, the first side connected to a generatrix of the hub, the second side connected to the one of the plurality of arms along a length of the second side, the third side facing the concave region.

15. The impeller according to claim 12, wherein the one of the plurality of arms has a region of reduced thickness adjacent to the hub, the region extending over a portion of the rib.

16. A centrifugal blower comprising:

a motor having a motor shaft; and the impeller according to claim 12.

17. An air distribution system selected from the group consisting of a heating system for a motor vehicle, a ventilating system for a motor vehicle and an air conditioning system for a motor vehicle, including the centrifugal blower of claim 16.

18. A motor vehicle including the air distribution system according to claim 17.

19. A method of forming the impeller according to claim 12 through the use of injection molding.

20. An impeller for a centrifugal blower, comprising:

a hub adapted to mount onto a motor shaft of the centrifugal blower;

a crown portion including means for directing air flow;

a plurality of arms connected between the hub and the crown portion, the plurality of arms defining a generally concave region; and means, connected between one of the plurality of arms and the hub in the concave region, for reinforcing the one of the plurality of arms.

* * * * *

UNITED STATES PATENT AND TRADEMARK OFFICE

CERTIFICATE OF CORRECTION

PATENT NO. : 6,095,752
DATED : August 1, 2000
INVENTOR(S) : Pascale Gronier et al.

It is certified that error appears in the above-identified patent and that said Letters Patent is hereby corrected as shown below:

Title page,
Item [73], Assignee, please delete "Valeo Clamitisation" and insert therefor -- Valeo Climatisation --.

Signed and Sealed this

Twenty-sixth Day of October, 2004

JON W. DUDAS
*Director of the United States Patent and Trademark Office*